US005639353A

United States Patent [19]

Calderon

[11] Patent Number: 5,639,353

[45] Date of Patent: Jun. 17, 1997

[54] APPARATUS FOR CARBONIZING MATERIAL

[76] Inventor: Albert Calderon, P.O. Box 126, Bowling Green, Ohio 43402

[21] Appl. No.: 708,291

[22] Filed: Sep. 4, 1996

Related U.S. Application Data

[63] Continuation-in-part of Ser. No. 336,399, Nov. 9, 1994, Pat. No. 5,607,556.

[51] Int. Cl.[6] ..... C10B 47/00

[52] U.S. Cl. ..... 201/15; 201/35; 201/40; 201/44; 202/99

[58] Field of Search ..... 201/15, 40, 44, 201/13, 14, 35; 202/96, 99; 432/209, 218; 422/196, 197

[56] References Cited

U.S. PATENT DOCUMENTS

| | | | |
|---|---|---|---|
| 1,018,331 | 2/1912 | Mathesius | 432/218 |
| 1,953,040 | 3/1934 | Brandegee | 201/15 |
| 2,224,823 | 12/1940 | Klein et al. | 201/15 |
| 2,922,752 | 1/1960 | Reintjes . | |
| 4,098,589 | 7/1978 | Buswell et al. | 48/94 |
| 4,389,283 | 6/1983 | Calderon | 201/19 |
| 4,469,488 | 9/1984 | Calderon | 48/202 |
| 4,810,472 | 3/1989 | Andrews et al. | 422/197 |
| 5,279,278 | 1/1994 | Logtens et al. | 126/116 R |
| 5,356,530 | 10/1994 | Calderson | 208/108 |

*Primary Examiner*—Christopher Kim
*Attorney, Agent, or Firm*—Marshall & Melhorn

[57] ABSTRACT

An apparatus for the carbonization of materials, such as coal, comprising an elongated coking retort defined by an annulus which constitutes the coking chamber within which the coal is carbonized indirectly by conduction. In order to provide an efficient mechanism for transferring thermal energy to the coal by conduction, highly conductive tiles equipped with flues and adapted to transport hot flue gas makes up the walls of the annulus within which the coal is carbonized. The raw gas (discharged from carbonization) and the cooled flue gas (discharged from the flues) are collected and separately treated to prevent polluting emissions.

17 Claims, 1 Drawing Sheet

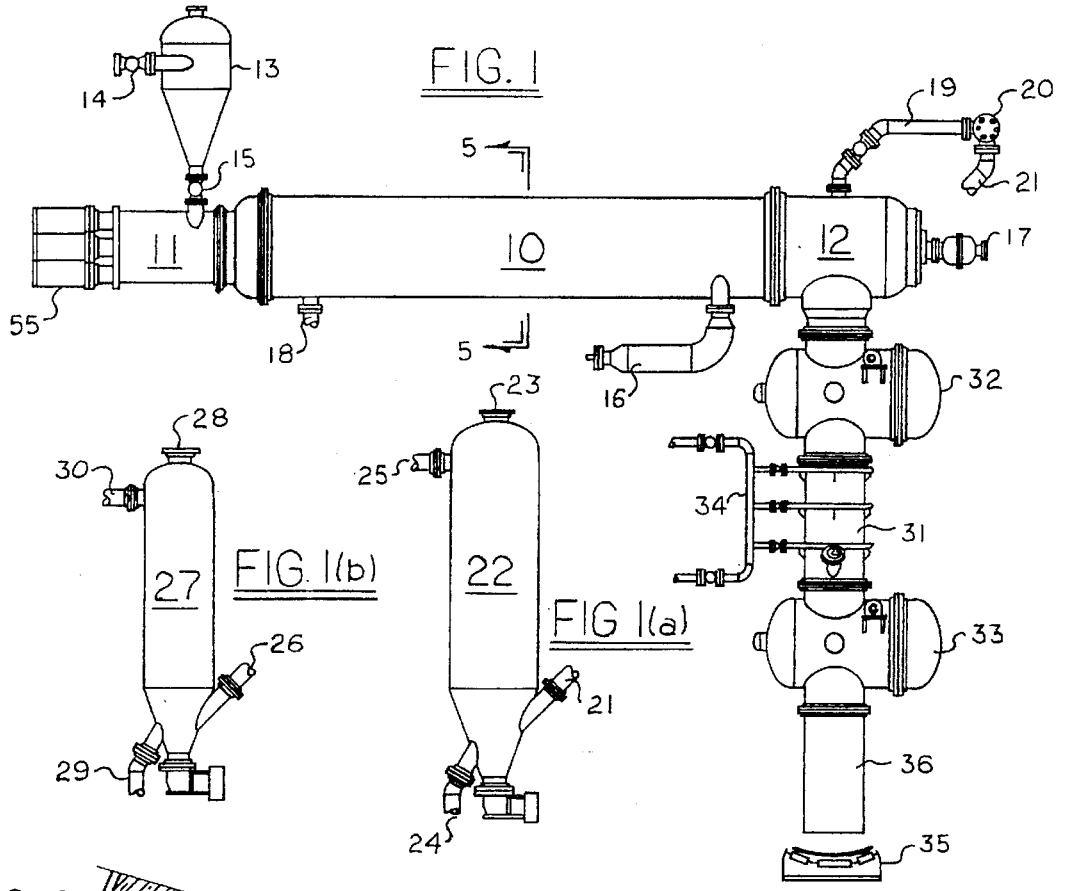
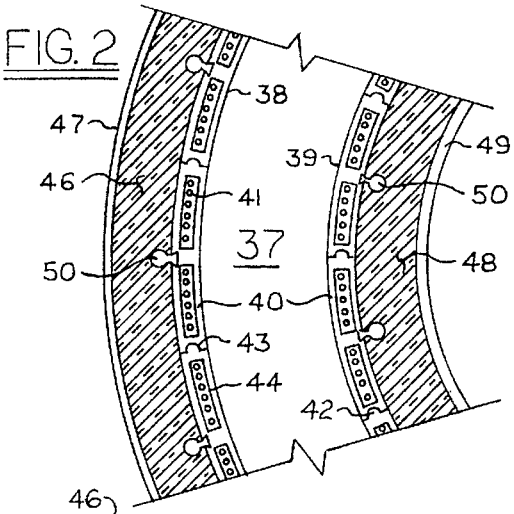
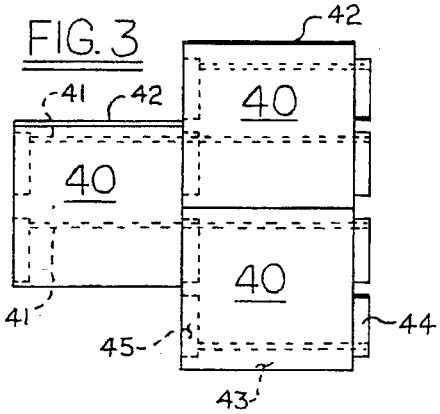
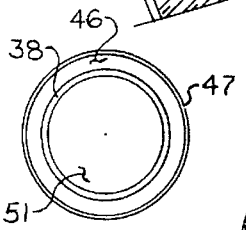
FIG. 6
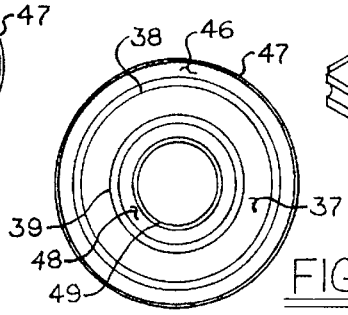
FIG. 5
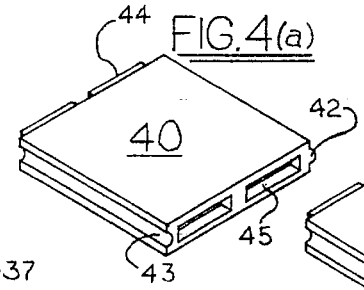
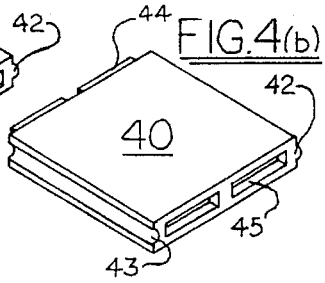

APPARATUS FOR CARBONIZING MATERIAL

This invention is a continuation in-part of the applicant's patent application bearing Ser. No. 08/336,399 filed on Nov. 9, 1994, U.S. Pat. No. 5,607,556, which is herein incorporated by reference.

BACKGROUND OF THE INVENTION

This referenced application discloses a method for continuously producing coke by providing an elongated coking chamber having an annulus, and by force feeding coal in a charging end of the annulus and compacting the coal against the outer and inner walls which form the annulus, and by continuously carbonizing the coal into coke by heating the coal bi-directionally in the annulus of the coking chamber by means of conductive heat as the coal passes through the elongated chamber.

OBJECTIVES OF THE INVENTION

The present invention provides an apparatus to carry out the above referenced method and also a coking chamber that provides a structure that efficiently transfers thermal energy from flues to the coal by conduction. This structure incorporates a highly conductive ceramic material such as silicon-carbide which can withstand high temperature (above 1000° C.) while still maintain its strength, be resistant to chemical attack by gas from coal, and be resistant to the erosive properties of coke. Such material is used in the structural configuration of the coking chamber in which the coal is converted to coke.

Conventionally coke is made in ovens using silica brick which can withstand high temperature, be resistant to chemical attack and be resistant to the erosive properties of coke; however, its conductivity is poor by virtue of its coefficient of thermal conductivity being around 1.7W(mK) when compared to a silicon-nitride bonded silicon-carbide which has a coefficient of thermal conductivity of about 16W (mK)—namely 940% more conductive. Such conductivity makes it possible to drive the thermal energy into the coal at a substantially faster rate than conventionally, thereby increasing the productivity of coke from the coking chamber.

Therefore, the main object of the present invention is to provide an efficient apparatus for the carbonization of materials such as coal within a coking chamber having an annulus formed by an outer wall and an inner wall with a space in between wherein the coal is heated bi-directionally within said space by conduction.

Another object of the present invention is to provide an apparatus for the carbonization of materials such as coal having a coking chamber that possesses structural features that transfer the thermal energy to the coal to be coked in a substantially more efficient manner than conventional coking.

Further another object of the present invention is to provide an apparatus that can carbonize materials at pressure and without causing emissions which are detrimental to the environment.

BRIEF DESCRIPTION OF THE DRAWINGS

FIG. 1 is a diagram of the apparatus to carbonize materials with the gas treating portion shown in FIG. 1(*a*) and FIG. 1(*b*).

FIG. 2 is a partial view of the coking chamber in which the materials are carbonized.

FIG. 3 is an arrangement of tiles containing heating flues.

FIG. 4 is a three dimensional view of tiles with the mating surfaces of the tiles being shown in FIG. 4(*a*) and FIG. 4(*b*).

FIG. 5 is a section taken at 5—5 of FIG. 1 showing the structure of the coking chamber.

FIG. 6 is a section of a coking chamber lined with tiles of slightly different configuration than that shown in FIG. 5.

DESCRIPTION OF THE INVENTION

Before proceeding with the description, by way of example "coal" shall be used for the material to be coked; this shall not mean that other materials cannot be used. Reference is made to FIG. 1 wherein the coking chamber is denoted by numeral 10. Numeral 11 is the coal charging equipment and numeral 12 is the coke discharge end. Charging equipment 11 communicates with lockhopper 13 which feeds the coal using valves 14 and 15 for control without causing emissions and loss of system pressure. Coking chamber 10 possesses burners 16 and 17 for providing hot flue gas for indirectly heating the coal. The flue gas is discharged via pipe 18. The raw gas leaves coking chamber 10 via conduit 19 and is collected by main 20 which serves to collect the raw gas from several coking chambers (not shown) similar to chamber 10. A cracker denoted by numeral 22, serves to crack and desulfurize the raw gas from chamber 10. The raw gas from main 20 is guided to enter into gas cracker 22 (in FIG. 1(*a*)) via pipe 21 (shown broken). Cracker 22 has a top nozzle denoted by numeral 23 for the entry of the catalyst and a bottom nozzle denoted by numeral 24 for the discharge of the catalyst. The cracked, desulfurized gas leaves cracker 22, via port 25. The flue gas from pipe 18 (in FIG. 1), if required to be treated, is directed by means of pipe 26 in FIG. 1(*b*) which is the continuation of pipe 18, into a contactor which is denoted by numeral 27 (in FIG. 1(*b*)). Contactor 27 possesses entry point 28 and exit point 29 for the respective receipt and discharge of a catalyst. The treated flue gas leaves contactor 27 via port 30.

The incandescent coke is discharged into a quenching chamber, denoted by numeral 31 via discharge end 12 and via valve 32 (in the open position). Valve 33 in the closed position forms the bottom of quenching chamber 31. Steam and water sprays are provided to chamber 31, which are denoted by numeral 34, in order to cool the coke prior to discharging it onto conveyor 35 via chute 36.

Referring to FIG. 2 for the detailed description of coking chamber 10, the annulus which contains the coal is denoted by numeral 37. This annulus is configured by two concentric walls of tiles, outer wall 38 and inner wall 39. The tiles which make up walls 38 and 39 and which are denoted by numeral 40, are made of a silicon-carbide such as silicon-nitride bonded silicon-carbide with heating flues denoted by numeral 41, being disposed within tiles 40 for the flow of hot flue gases. Flues 41 are preferably disposed axially in tiles 40 in the form of assemblies of groups. Tiles 40 possess a tongue and groove arrangement denoted by numerals 42 and 43 respectively in order to interlock tiles 40 radially. Also tiles 40 possess a tenon and mortise arrangement denoted by numerals 44 and 45 respectively in order to interlock tiles 40 axially. Wall 38 and/or wall 39 may possess a taper to diverge toward discharge end 12 in order to provide relief to the coal passing through annulus 37.

Wall 38 is backed-up by insulation 46 which in turn is contained by outer pressure shell 47, and wall 39 is backed-up by insulation 48 which in turn is contained by inner pressure shell 49. Tiles 40 are also secured to insulation 46 and insulation 48 by means of anchors such as anchor 50. FIGS. 3 and 4 show additional representations of tiles 40 and their interlocking arrangements. FIGS. 4(*a*) and 4(*b*) further illustrate the interlocking arrangements of tiles 40. These tiles are laid in courses to form the structure of coking chamber 10.

Referring to FIG. 5 which shows coking chamber 10 in section, the numerals indicate the parts described in FIG. 2. In FIG. 6, the annulus has been omitted in order to show a variation of chamber 10 wherein a single circular wall of tile is employed within which the coal is coked. The outer shell is denoted by numeral 47, the insulation by numeral 46, the heating wall which is made of tile by numeral 38, and the carbonization chamber proper by numeral 51.

The operation of the instant invention will be described using coal by way of example. The coal is fed through lockhopper 13 using valves 14 and 15 in order to prevent gases from escaping from coking chamber 10. The coal is compacted and advanced within chamber 10 by means of charging equipment 11 which includes pushing cylinder(s) 55. The coal is efficiently heated by conduction in annulus 37, by virtue of the high conductivity of tiles 40, and carbonized bi-directionally into coke in the absence of oxygen by the continuous passage of hot gases axially through flues 41 which are disposed in tiles 40. The coal charging rate, and its residence time within chamber 10 are coordinated in such a way as to have the coal converted to coke when the charge reaches discharge end 12. During coking the process pressure in chamber 10 and the pressure in flues 41 are adjusted to minimize migration of gas from chamber 10 into flues 41 through the joints of tiles 40, and vice versa. It is preferred to operate the process pressure somewhat higher than the pressure in the flues in order to force the deposit of carbon in the joints caused by the cracking of hydrocarbons contained in the gases devolatilized from the coal. The flue gas leaving flues 41 is treated in contactor 27 prior to its discharge into the atmosphere to insure that no polluting emissions occur in the event of any raw gas migration from the annulus to the flues. The raw gas released from the coal containing deleterious components such as tar, hydrogen sulfide, ammonia, phenols, cyanide, benzene, etc. is treated in cracker 22.

Hot glowing coke is pushed into quenching chamber 31 while valve 32 is open and valve 33 is closed. Initially steam is injected into chamber 31 to form water gas, this water gas is mixed with the raw gas and both are cleaned in cracker 22. When the water gas reaction slows down and the coke is partially cooled, valve 32 is closed, the injection of steam is stopped, chamber 31 is depressurized, and water is injected to complete the cooling of the coke. The cold coke is discharged into the atmosphere by opening valve 33, without causing pollution. If desired the cooling of the coke can take the form of dry quenching (known in the art) in order to recover the heat from the hot coke.

During carbonization the temperature of tiles 40 is maintained high enough to cause hydrocarbons that come in contact with tiles 40 to cause the cracking of such hydrocarbons against the tiles with the result of deposition of carbon on tiles 40. The operation of carbonization is conducted at pressure which could range from a few ounces to scores of atmospheres, depending upon the ultimate use of the gas produced from the coal. With the aid of process pressure within coking chamber 10, the carbon which is deposited onto tiles 40 is forced to impregnate the tiles and the joints between the tiles to cause the sealing of the tiles themselves as well as the joints.

It is contemplated to assemble several coking chambers, such as chamber 10, together in order to form a battery of producing units to respond to commercial production needs. The details of construction described above are for the purpose of description and not limitation since other configurations are possible without departing from the spirit of the invention. Further other materials besides coal can be carbonized in the apparatus herein described.

Therefore I claim the following:

1. Apparatus for carbonizing a material comprising:

a) a coking chamber including an annulus which is defined by an outer wall, an inner wall and a space between the two walls to contain the material to be carbonized;

b) a first flue assembly disposed to said outer wall for the passage of hot flue gases in order to indirectly heat the material to be carbonized by conduction in one direction, and a second flue assembly disposed to said inner wall for the passage of hot flue gases in order to indirectly heat the material to be carbonized by conduction in the opposite direction, to result in heating said material in said annulus bi-directionally to produce a coke and a raw gas; and c) a charging mechanism to force feed the material to be carbonized into one end of said annulus by compaction while forcing the discharge of the carbonized material from the opposite end of said annulus;

wherein the outer wall and the inner wall of said annulus are equipped with a heat conductive lining which is resistant to chemical attack by the untreated gases released during carbonization and which is resistant to abrasion by the material being carbonized while such material passes through said annulus.

2. The apparatus set forth in claim 1 wherein the heat conductive lining is comprised of tiles that form the outer wall and the inner wall of said annulus.

3. The apparatus set forth in claim 2 wherein heating flues are included in said tiles.

4. The apparatus set forth in claim 2 wherein said tiles comprises securing means to hold said tiles in place.

5. The apparatus set forth in claim 2 wherein said tiles are secured in such a way as to have the individual tiles interlock with each other.

6. The apparatus set forth in claim 5 wherein said individual tiles possess tongue and groove features for interlocking with each other radially.

7. The apparatus set forth in claim 5 wherein said individual tiles possess tenon and mortise features for interlocking with each other axially.

8. The apparatus set forth in claim 2 wherein said tiles possess anchoring features in the opposite side of the side of the tiles which is exposed to the material to be carbonized.

9. The apparatus set forth in claim 2 wherein said tiles that form the outer wall and the inner wall of said annulus are made of silicon-carbide.

10. The apparatus set forth in claim 9 wherein said silicon-carbide includes a silicon-nitride bonded silicon-carbide.

11. The apparatus set forth in claim 1 further comprising a cooling chamber to drop the temperature of the carbonized material prior to its discharge into the atmosphere.

12. The apparatus set forth in claim 1 wherein said coking chamber further comprises a pressure containment means which enables a positive pressure operation.

13. The apparatus set forth in claim 12 further comprising a lockhopper means for admitting material to be carbonized into said coking chamber and lockhopper means for discharging carbonized material from said coking chamber in order to operate without loss of pressure.

14. The apparatus set forth in claim 2 wherein insulating material is used in conjunction with said tiles in order to minimize heat loss from said coking chamber.

15. The apparatus set forth in claim 1 further comprising a taper in said annulus.

16. The apparatus set forth in claim 1 further comprising a cracking and desulfurization means for treating the gas produced from carbonization.

17. The apparatus set forth in claim 1 further comprising a contactor means for treating flue gases discharged from said flue assemblies.

* * * * *